US007247068B2

(12) United States Patent
Iwakami et al.

(10) Patent No.: US 7,247,068 B2
(45) Date of Patent: Jul. 24, 2007

(54) BOAT PROPULSION UNIT

(75) Inventors: Hiroshi Iwakami, Saitama (JP); Atsushi Kusuda, Saitama (JP); Masahiko Tsuchiya, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/378,138

(22) Filed: Mar. 17, 2006

(65) Prior Publication Data

US 2006/0217013 A1 Sep. 28, 2006

(30) Foreign Application Priority Data

Mar. 25, 2005 (JP) ..... 2005-088623

(51) Int. Cl.
*B63H 20/28* (2006.01)

(52) U.S. Cl. ..... 440/88 M; 440/38

(58) Field of Classification Search ..... None
See application file for complete search history.

(56) References Cited

U.S. PATENT DOCUMENTS 5,472,359 A * 12/1995 Allbright et al. ..... 440/38
5,788,547 A * 8/1998 Ozawa et al. ..... 440/89 R
6,036,556 A * 3/2000 Baker et al. ..... 440/38
6,171,158 B1 * 1/2001 Henmi et al. ..... 440/38
6,659,816 B2 * 12/2003 Fuse ..... 440/38
6,881,109 B2 * 4/2005 Matsuda et al. ..... 440/39

FOREIGN PATENT DOCUMENTS

JP 2003-246298 9/2003

* cited by examiner

*Primary Examiner*—Lars A. Olson
(74) *Attorney, Agent, or Firm*—Carrier, Blackman & Associates, P.C.; Joseph P. Carrier; William D. Blackman

(57) ABSTRACT

A propulsion unit for a boat has a cooling water intake structure through which entry of cooling water is obstructed when the boat is towed while the impeller is not turned, and through which sufficient cooling water enters when the impeller is turned. The propulsion unit includes an impeller, plural stationary blades provided on the downstream side of the impeller, and a cooling water intake structure. The intake structure is disposed between adjacent first and second stationary blades, on the side of the first stationary blade relative to a bisecting line between the two stationary blades. Hydraulic pressure on the side of the first stationary blade, relative to the bisecting line, is lowered by guide action of the impeller, and hydraulic pressure on the side of the second stationary blade relative to the bisecting line is raised, respectively, when the boat is towed while the impeller is stopped.

10 Claims, 7 Drawing Sheets

FIG. 4
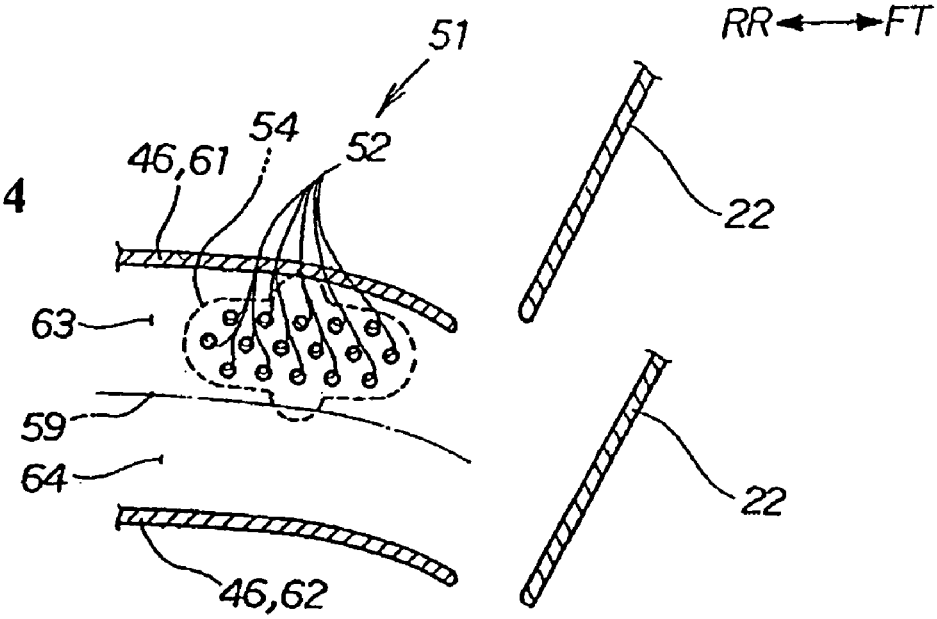
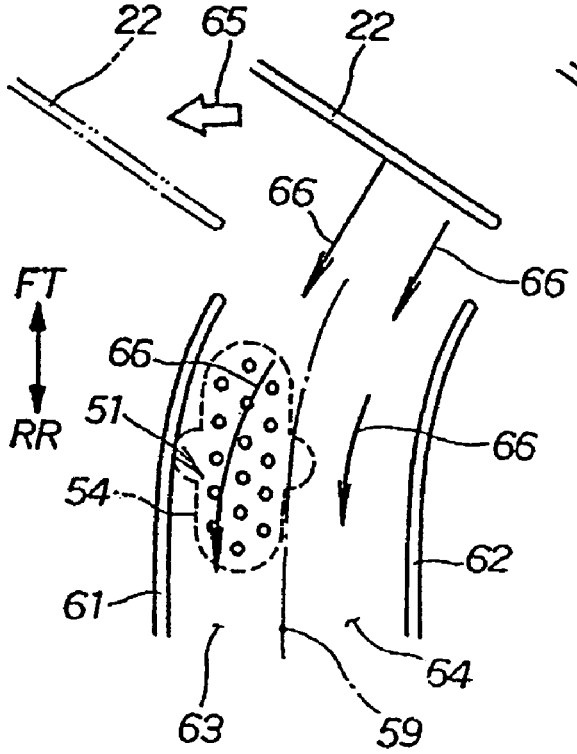
FIG. 5A
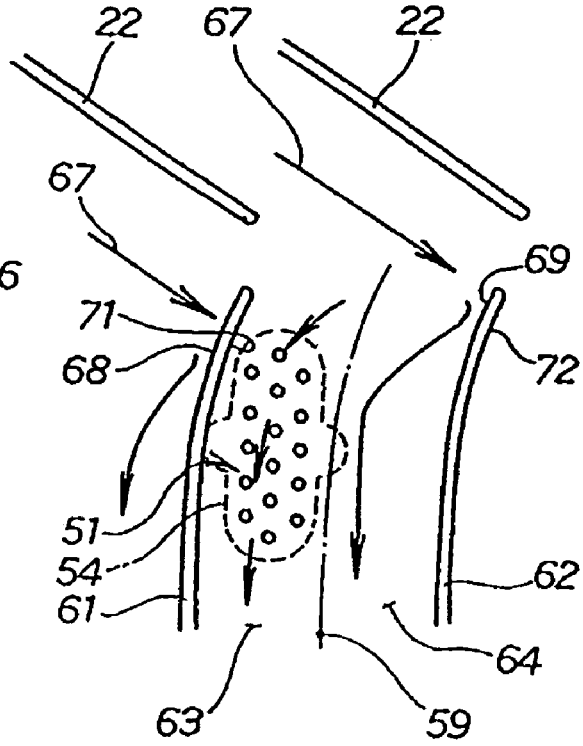
FIG. 5B

BOAT PROPULSION UNIT

CROSS-REFERENCE TO RELATED APPLICATIONS

The present invention claims priority under 35 USC 119 based on Japanese patent application No. 2005-088623, filed on Mar. 25, 2005. The subject matter of these priority documents is incorporated by reference herein.

BACKGROUND OF THE INVENTION

1. Field of the Invention

The present invention relates to a propulsion unit for a boat. The propulsion unit is provided with a rotatable impeller in a cylindrical pump housing, and includes stationary blades, disposed on the downstream side of the impeller, for guiding a fluid stream in an axial direction of the pump housing.

2. Description of the Background Art

It is well known it provide a propulsion unit for a boat with an impeller in a pump housing, where the propulsion unit includes stationary blades on the downstream side of the impeller for guiding a fluid stream in an axial direction of the pump housing, and an intake for extracting cooling water. Such a propulsion unit is disclosed, for example, in Japanese published patent document JP-A No. 246298/2003 (FIGS. 1 and 2).

FIG. 8 of the present drawings is a reproduction of FIG. 1 taken from JP-A No. 246298/2003 for comparative purposes, and is a sectional view showing the configuration of a water propulsion unit of a small-sized boat. In the known water propulsion unit P of FIG. 8, the unit P is provided with a front casing 121Cf and a rear casing 121Cr fitted to the front casing 121Cf. Also in the known water propulsion unit P of FIG. 8, a joint gap 102 is provided to a part in which these casings 121Cf, 121Cr are fitted, and a cooling water 101 intake is provided in the joint gap.

The detailed structure of the prior art cooling water intake will be described below.

FIG. 9 is a reproduction of FIG. 2*a* from JP-A No. 246298/2003, and shows a configuration in which the two casing components 121Cf, 121Cr of the water propulsion unit are fitted, and shows that cooling water is taken in by providing the joint gap 102 at the location in which the front casing 121Cf and the rear casing 121Cr are fitted, forming ringed space 103 in the joint gap 102. The cooling water intake 1 (hereinafter only called the intake 1) is attached to the space 103.

Incidentally, this type of boat may be towed by another boat, except while running normally. However, when the boat according to this known design is towed while its engine is stopped, a considerable quantity of water may enter a water muffler from the intake 1, even though the impeller is stopped, as a result of the boat being pulled through the water. When water exceeding a defined quantity accumulates in the water muffler, startability of the engine is negatively affected.

Therefore, a propulsion unit provided with an intake in which minimal cooling water enters when a boat is towed, and which can take in sufficient cooling water when an impeller is turned, is desired.

SUMMARY OF THE INVENTION

The present invention provides an improved propulsion unit for a boat, where the propulsion unit is provided with an intake structure, from which minimal cooling water enters when the boat is towed by another boat without turning an impeller, and which can take necessary and sufficient quantity of cooling water in when the impeller is turned.

A first aspect of the invention relates to a propulsion unit for a boat provided with a rotatable impeller in a cylindrical pump housing. The propulsion unit includes plural stationary blades on the downstream side of the impeller for guiding a fluid stream in an axial direction of the pump housing. The invention is characterized in that an intake structure, for extracting cooling water sent to an engine, is provided between two adjacent stationary blades in the pump housing, along with a water muffler and other water-cooled components. A center line between two stationary blades is called a bisector of the two stationary blades. The hydraulic pressure on the side of one stationary blade relative to the bisector is lowered by the guide action of the impeller, and the hydraulic pressure on the side of the other stationary blade relative to the bisector rises, respectively, when the boat is towed while the impeller is stopped. In addition, the intake structure is provided on the side of one stationary blade relative to the bisector.

A second aspect of the invention is characterized in that a cooling water passage is provided for sending cooling water to an engine, a water muffler, and other components from an intake structure. The cooling water passage is formed separately, and is disposed outside of a pump housing, and the intake structure is configured by a plurality of small holes.

A third aspect of the invention is related to a propulsion unit for a boat provided with a rotatable impeller in a cylindrical pump housing. The propulsion unit includes plural stationary blades on the downstream side of the impeller for guiding a stream in an axial direction of the pump housing. The invention is characterized in that an intake structure for extracting cooling water sent to an engine, a water muffler and other components is provided between adjacent two stationary blades in the pump housing. A center line between the two stationary blades is called a bisector of the two stationary blades. The hydraulic pressure on the side of one stationary blade relative to the bisector is lowered by the guide action of the impeller, and the hydraulic pressure on the side of the other stationary blade relative to the bisector is raised, respectively, when the boat is towed while the impeller is stopped. The intake structure is provided between the two stationary blades with the intake structure displaced relative to the bisector on the side of one stationary blade.

A fourth aspect of the invention is characterized in that one stationary blade is located on the downstream side of the other stationary blade, the downstream side corresponding to a side in a direction in which the impeller is turned.

According to the first aspect of the invention, since the intake structure is provided to the part on the side of one stationary blade relative to the bisector, that is, to the part in which hydraulic pressure lowered when the boat is towed, minimal water enters via the intake structure. Since minimal water enters the intake structure, minimal water enters an exhaust system such as the water muffler when the engine is stopped and the boat is towed by another boat.

Since minimal water enters the exhaust system such as the water muffler, the startability of the engine can be enhanced. In the meantime, since high pressure is applied to the part on the side of one stationary blade relative to the bisector when the impeller is turned during normal propulsion unit operation, cooling water can be efficiently taken in via the intake structure.

According to the second aspect of the invention, since the intake structure is configured by plural small holes, the turbulence of a stream in the pump housing can be inhibited. In addition, since the cooling water passage is separately formed outside the pump housing, the intake structure can be easily formed on the pump housing.

Moreover, the second aspect of the invention provides an advantage in that since the cooling water passage is a separate body, the pump housing can be easily formed and the manufacturing cost of the pump housing can be inhibited.

According to the third aspect of the invention, since the intake structure is provided on the part between two stationary blades and on the side of one stationary blade relative to the bisector, that is, is provided with the intake structure displaced toward the part in which hydraulic pressure is lowered when the boat is towed, minimal water enters via the intake structure. Since minimal water enters the intake structure, minimal water enters the exhaust system such as the water muffler when the engine is stopped and the boat is towed by another boat.

Since minimal water enters the exhaust system such as the water muffler, the startability of the engine is enhanced.

According to the fourth aspect of the invention, since one stationary blade is located on the downstream side of the other stationary blade in a direction in which the impeller is turned, and high pressure is applied to the part on the side of one stationary blade relative to the bisector when the impeller is turned in normal running, cooling water can be efficiently taken in from the intake structure.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

BRIEF DESCRIPTION OF THE DRAWINGS

FIG. 4 is a schematic diagram of the intake structure, stationary blades and an impeller showing the positional relation among the intake structure, stationary blades and an impeller according to the invention;

FIG. 5A is a schematic diagram of the intake structure, stationary blades and an impeller showing the flow of water on the left and on the right of a bisector between the stationary blades when the boat is advanced by rotation of the impeller.

FIG. 5B is a schematic diagram of the intake structure, stationary blades and an impeller showing the flow of water on the left and on the right of a bisector between the stationary blades when the boat is advanced while the impeller is stopped (when the boat is towed);

DETAILED DESCRIPTION

A selected illustrative embodiment of the invention will now be described in some detail, with reference to the drawings. In the figures, the frontward (FT) and rearward (RR) directions of the boat are indicated by the two-headed arrow. It should be understood that only structures considered necessary for clarifying the present invention are described herein. Other conventional structures, and those of ancillary and auxiliary components of the system, are assumed to be known and understood by those skilled in the art.

Figure 1:
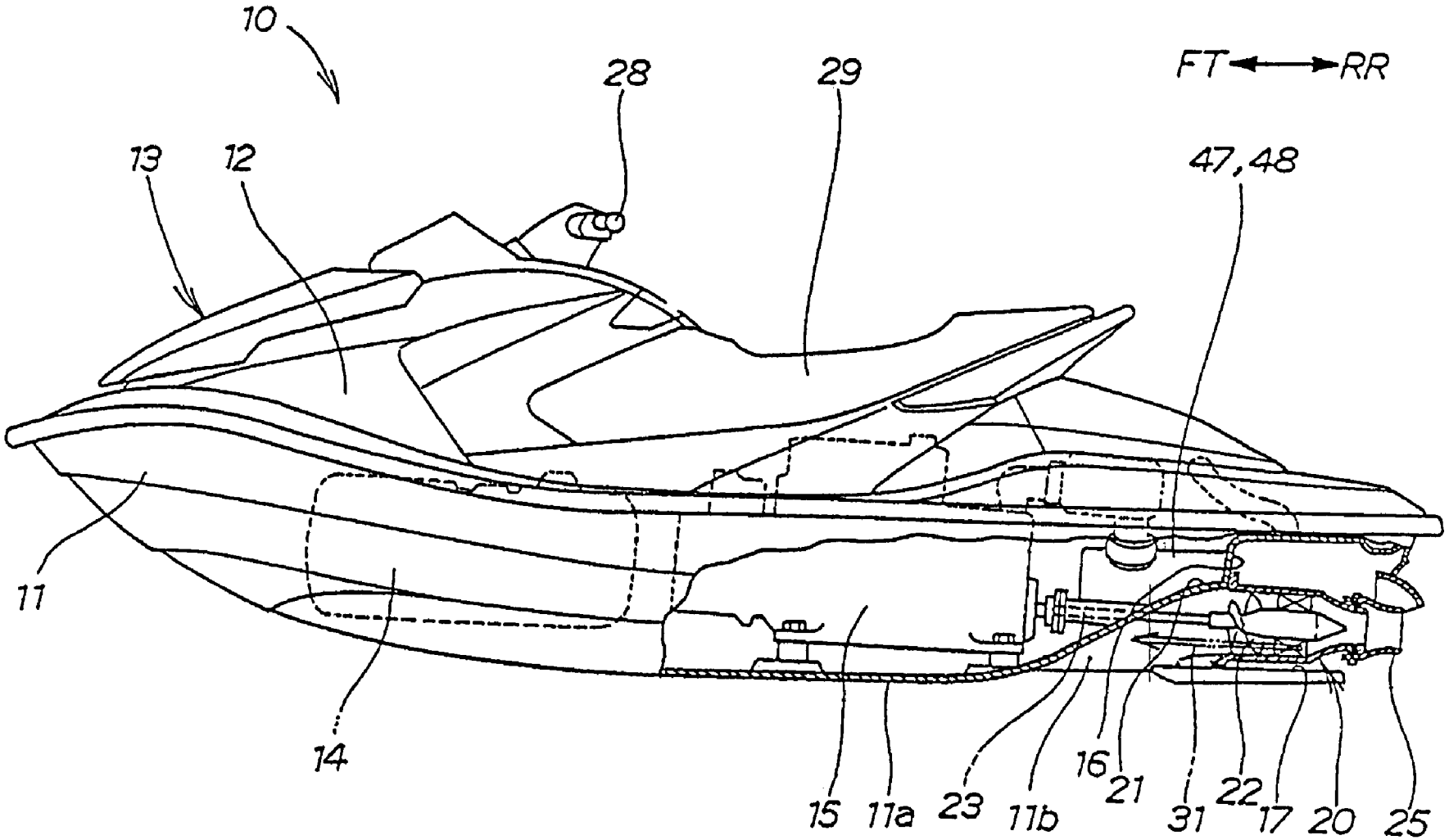
FIG. 1 is a side plan view, partially cut away and partially in section, of a boat provided with a propulsion unit according to the invention.

FIG. 1 is a side plan view, partially cut away and partially in section, of a boat provided with a propulsion unit according to a selected illustrative embodiment of the present invention. The boat 10 (also called a jet propulsion boat 10) includes a boat body 13 formed by layering a deck 12 on a hull 11. The hull 11 forms the bottom of the boat. A pair of steering handlebars 28 are attached to the body 13 above the fuel tank 14, and a saddle-type seat 29 is attached to the deck 12 at a location behind the steering handlebars 28.

A fuel tank 14 is provided in the body 13, an engine 15 is provided in the body at a location rearward of the back of the fuel tank 14, and a jet pump case 16 is provided on the body at a location rearward of the engine 15. A propulsion unit 20 (also called a jet pump 20) is provided within the jet pump case 16. A cooling water pipe 31, for supplying cooling water to the engine 15 and other water-cooled components of the boat 10, is also provided near the propulsion unit 20.

The propulsion unit 20 is provided with a pump housing 21 extending rearwardly from an opening 11*b* in the bottom 11*a* of the hull 11. An impeller 22 is rotatably attached in the pump housing 21, and is coupled to a drive shaft 23 of the engine 15. The engine 15 drives the propulsion unit 20 whereby the impeller 22 is turned, and water which has been drawn in through the opening 11*b* of the bottom 11*a* is jetted forcefully outwardly from a steering nozzle 25 via the pump housing 21.

The steering nozzle 25 is attached to the rear end of the pump housing 21 so that the steering nozzle swings in a lateral direction of the boat. The steering nozzle 25 is a steering member for controlling a direction in which the body 13 of the boat is steered. The operation of the steering handlebars 28 causes a lateral swing of the steering nozzle 25, with the result that the direction of the boat changes correspondingly.

As used herein, a jet propulsion boat 10 is understood to refer to a boat run by supplying fuel from the fuel tank 14 to the engine 15 to drive the engine 15, transmitting the driving force of the engine 15 to the impeller 22 via the drive shaft 23, drawing water into the opening 11*b* of the bottom 11*a* by turning the impeller 22, and jetting the water outwardly from the steering nozzle 25 through the rear end of the pump housing 21.

Figure 2:
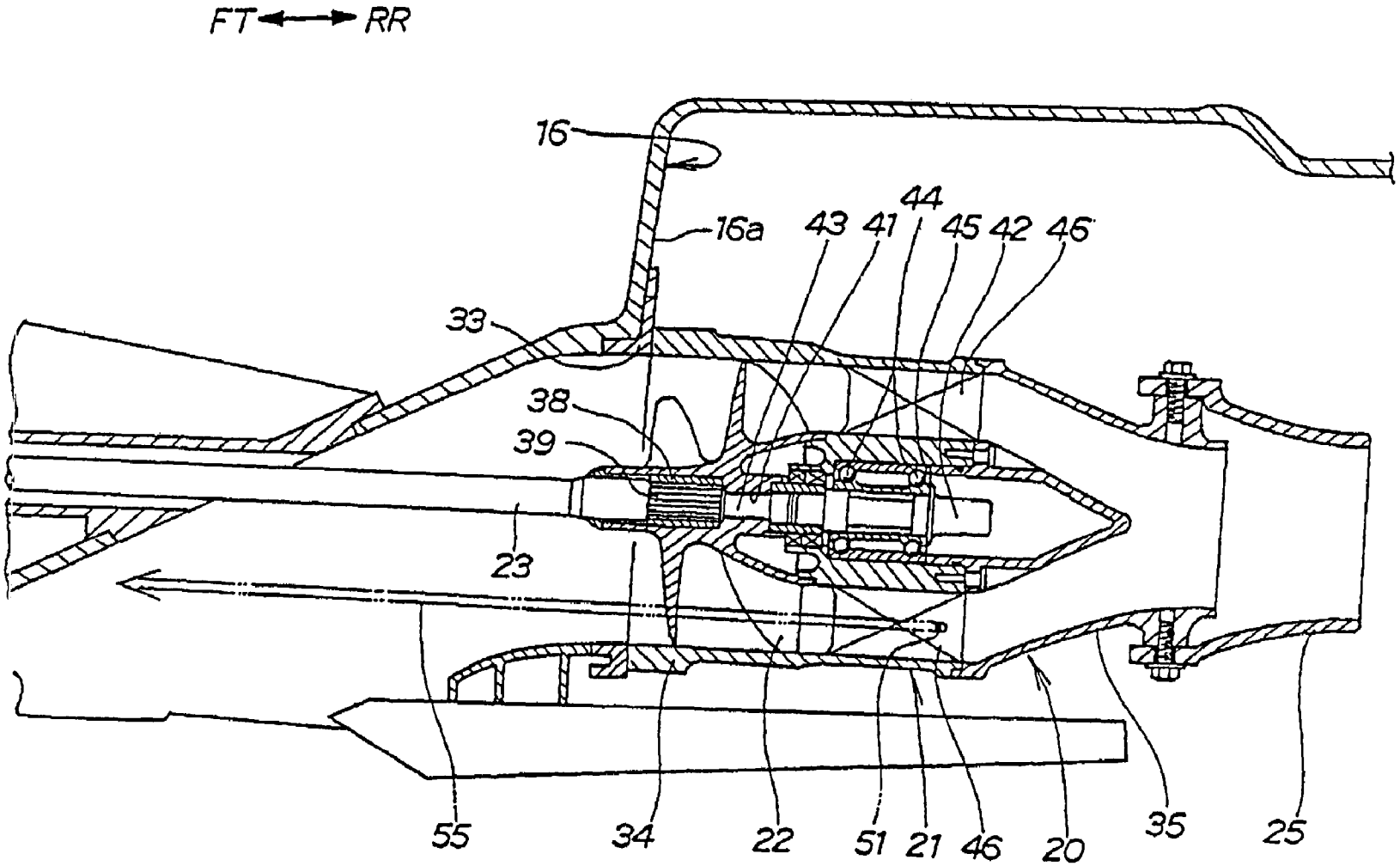
FIG. 2 is a side sectional view of the propulsion unit provided with an intake structure according to the invention, showing stationary blades disposed downstream of the impeller, and showing the location of the cooling water intake structure with respect to the stationary blades.

FIG. 2 is a side sectional view of the propulsion unit provided with an intake structure structure according to the selected embodiment of the invention. In the propulsion unit 20, a base 33 is attached to a wall 16*a* of the jet pump case 16. The cylindrical pump housing 21, configured by a cylindrical chamber 34 and an injection nozzle 35, is connected to the base 33. The impeller 22 is arranged in the cylindrical chamber 34. A male spline 39 of the drive shaft 23 is engaged with a female spline 38 of the impeller 22, and the front end of the drive shaft 23 is coupled to the engine 15 for rotation thereby (see FIG. 1). A male screw 43 of a support shaft 42 is screwed to a female screw 41 of the impeller 22, and the support shaft 42 is rotatably supported within a bearing member 45 of the cylindrical chamber 34 via bearings 44, 44.

The bearing member 45 is fixed to the rear of the cylindrical chamber 34 via plural stationary blades 46, and these plural stationary blades, provided on the cylindrical chamber 34, are members radially extended from the bearing member 45 to a cylinder part of the cylindrical chamber 34. In addition, the cooling water intake structure 51 is provided on the downstream side of the impeller 22. The cooling water intake structure takes in cooling water for cooling the engine 15, (see FIG. 1) and an exhaust system such as a water muffler 47.

That is, the propulsion unit 20 includes the rotatable impeller 22 disposed in the cylindrical pump housing 21, the plural stationary blades 46 disposed on the downstream side of the impeller 22 for guiding a fluid stream in an axial direction of the pump housing 21, and the intake structure 51 disposed between two stationary blades 46, 46 for extracting the cooling water to be sent to the engine 15 (see FIG. 1), the water muffler 47 and other water-cooled components.

In other words, the propulsion unit 20 provides a boat driving force by turning the impeller 22 through the driving force of the engine 15, the impeller 22 pushing out a fluid stream and jetting the fluid stream backward, the fluid stream guided by the plural stationary blades 46, and is provided with the intake structure 51 on the downstream side of the impeller 22, the intake structure supplying high-pressure cooling water taken in from the intake structure 51 to the engine 15 (see FIG. 1) and other water-cooled components.

Figure 3:
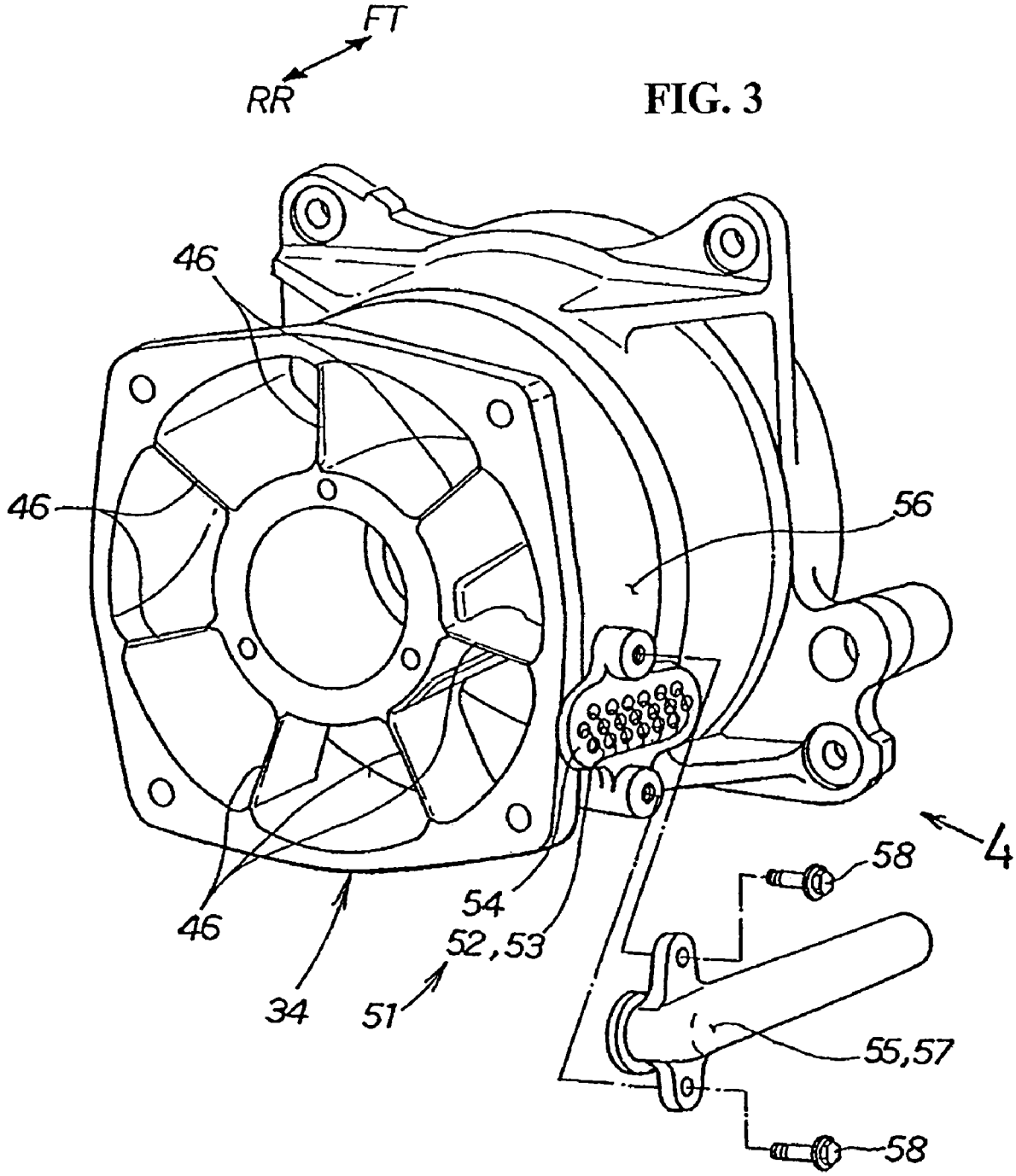
FIG. 3 is a rear perspective view of the propulsion unit isolated from the boat showing a stator provided with the intake structure according to the invention.

FIG. 3 is a perspective view of an isolated stator provided with an intake part according to the invention. A separate cooling water passage 55 is attached to a bracket seat 54 provided with intake outlets 53. The intake outlets 53 are formed by plural small holes 52 provided on the rear side of the cylindrical chamber 34.

Concretely, the intake structure 51, provided on an inner wall of the cylindrical chamber 34 and configured by the plural small holes 52, communicates with the intake outlets 53 provided on an outer wall 56 of the cylindrical chamber 34. The bracket seat 54 is provided with the outlets 53 of the intake structure, and a cooling pipe 57 which forms the cooling water passage 55, is attached to the bracket seat 54 via bolts 58, 58.

That is, the intake structure 51 is opened by boring the plural small holes 52 through the cylindrical chamber 34, which is one member of the pump housing 21. The intake structure 51 is provided with the plural small holes 52 communicating with the outlets 53 of the intake structure. The separate cooling water passage 55 is attached to the outside of the cylindrical chamber 34 to extract cooling water from the cylindrical chamber 34.

Since the intake structure 51 is configured by the plural small holes 52, turbulence of the fluid stream in the pump housing 21 is inhibited. In addition, since the cooling water passage 55 is separately formed and disposed outside the pump housing 21, the intake structure 51 can be easily formed on the cylindrical chamber 34, which is a part of the pump housing 21. Since the cooling water passage 55 is separately formed, the cylindrical chamber 34, which is a component of the pump housing 21, can be easily formed and the manufacturing cost of the pump housing 21 can be inhibited.

FIG. 4 is a side view of the cylindrical chamber 34 (see FIG. 3) in which the impeller 22 is attached, and is used to explain positional relationships among the intake structure, the stationary blades and the impeller according to the invention. The impeller 22 is arranged longitudinally in the boat 10, and the stationary blades 46 for rectifying water flow are arranged rearward of the impeller 22. A first stationary blade 61 is shown adjacent to, and spaced apart from a second stationary blade 62. A center line of the two adjacent stationary blades 61, 62 is called a bisector 59 of the stationary blades 61, 62. In the inventive configuration, the intake structure 51 is provided on a part 63 of the cylindrical chamber 34 disposed on the side of the bisector 59 nearest the first stationary blade 61.

Alternatively, the intake structure 51 can be provided biased to the side of the first stationary blade 61 between the two stationary blades 61, 62.

In this embodiment, all the small holes 52 configuring the intake structure 51 are biased on the side of the first stationary blade 61 relative to the bisector 59, however, the intake structure 51 may be also provided in a position overlapped with the bisector 59.

FIGS. 5A and 5B compare water flow on the left and on the right of the bisector 59 between the first and second stationary blades 61, 62 for different operating conditions. In FIG. 5A, the water flow is shown for the condition in which the boat is advanced by rotation of the impeller. In FIG. 5B, the water flow is show for the condition in which the boat is advanced while the impeller is stopped (when the boat is towed). FIGS. 5A and 5B are used to explain the effect of providing the intake structure 51 in the part 63 on the side of first stationary blade 61 relative to the bisector 59.

As shown in FIG. 5A, when the boat is advanced by rotation of the impeller 22, a fluid stream is caused to flow in the directions shown by arrows 66 because the impeller 22 is moved in a direction shown by an open arrow 65, is rectified by the stationary blades 61, 62, and flows toward the rear of the boat 10. As hydraulic pressure rises and a large quantity of water flows in the part 63 on the side of the first stationary blade 61 relative to the bisector 59, compared with the quantity of water that flows when the impeller 22 is not turned. As a result, water is taken in from the intake structure 51, and cooling water for cooling the engine 15 (see FIG. 1) and the exhaust system can be taken in a sufficient quantity. Since the sufficient quantity of cooling water can be taken in, predetermined cooling performance can be easily secured if only fixed or more area can be secured in the intake structure 51.

That is, since the first stationary blade 61 is located on the downstream side of the second stationary blade 62 in a rotational direction of the impeller 22, and high pressure is applied to the part on the side of the first stationary blade 61 relative to the bisector when the impeller 22 is normally operated, cooling water can be efficiently taken in from the intake structure 51.

As shown in FIG. 5B, when the boat is advanced while the impeller 22 is stopped (for example, when the boat is towed), hydraulic pressure does not rise because the part 63 of the cylindrical chamber 34 on the side of the first stationary blade 61 is obstructed by the first stationary blade 61 (see the left-most flow arrow having a reference number 67). In addition, only a small quantity of water flows while the impeller is stopped, compared with quantity in the other part 64 of the cylindrical chamber 34 on the side of the second stationary blade 62.

To concretely explain the flow path of the fluid stream when the boat is towed, the stream flows in a direction shown by an arrow 67 between the impellers 22, 22, hits on the stationary blades 61, 62, and its direction is greatly changed. Therefore, the fluid stream hits directly on the downstream sides 68, 69 of the stationary blades 61, 62 (downstream relative to the rotational direction of the impeller 22), and does not directly hit on the upstream sides 71, 72 of the stationary blades 61, 62 (upstream relative to the rotational direction of the impeller 22).

Therefore, when hydraulic pressure applied to one part 63 and hydraulic pressure applied to the other part 64 are compared, the hydraulic pressure in one part 63 is lowered and the hydraulic pressure in the other part 64 is raised. Since the intake structure 51 is provided on one part 63, and the hydraulic pressure in one part 63 is lowered, minimal water enters the intake structure 51.

Figure 6:
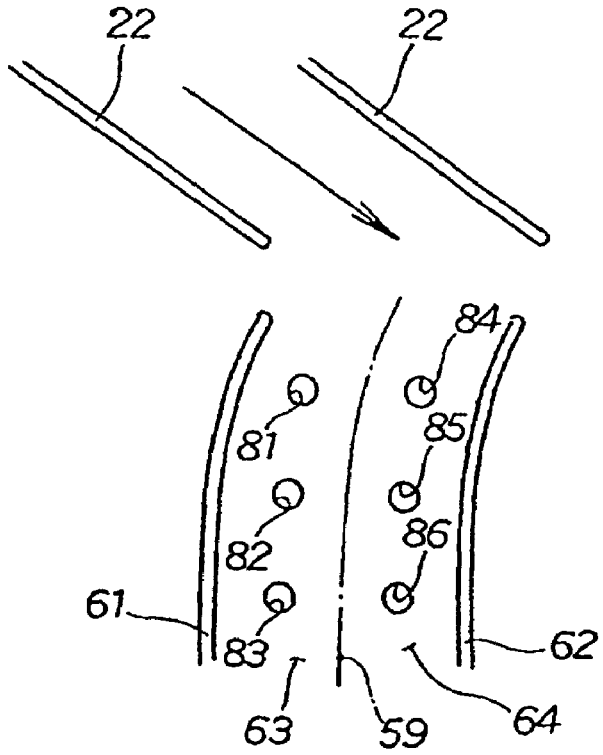
FIG. 6 is a schematic diagram of the stationary blades and an impeller for explaining an experiment for measuring the hydraulic pressure of plural small holes open to a pump housing when the boat is advanced though the impeller is stopped (when the boat is towed)

FIG. 6 is a side view of the cylindrical chamber 34 (see FIG. 3) in which the impeller 22 is attached, and is used to explain an experiment for measuring the hydraulic pressure of the plural small holes open to the cylindrical chamber 34 when the boat is advanced while the impeller is stopped (for example, when the boat is towed). Openings 81, 82, 83 are provided within the part 63 on the side of the first stationary blade 61 located on the left side of the bisector 59 between the stationary blades 61, 62. In addition, openings 84, 85, 86 are similarly provided within the other part 64 on the side of the second stationary blade 64 located on the right side of the bisector 59. The hydraulic pressure of each opening 81 to 86 is measured during conditions in which the boat 10 (see FIG. 1) is towed while the impeller 22 is stopped.

Figure 7:
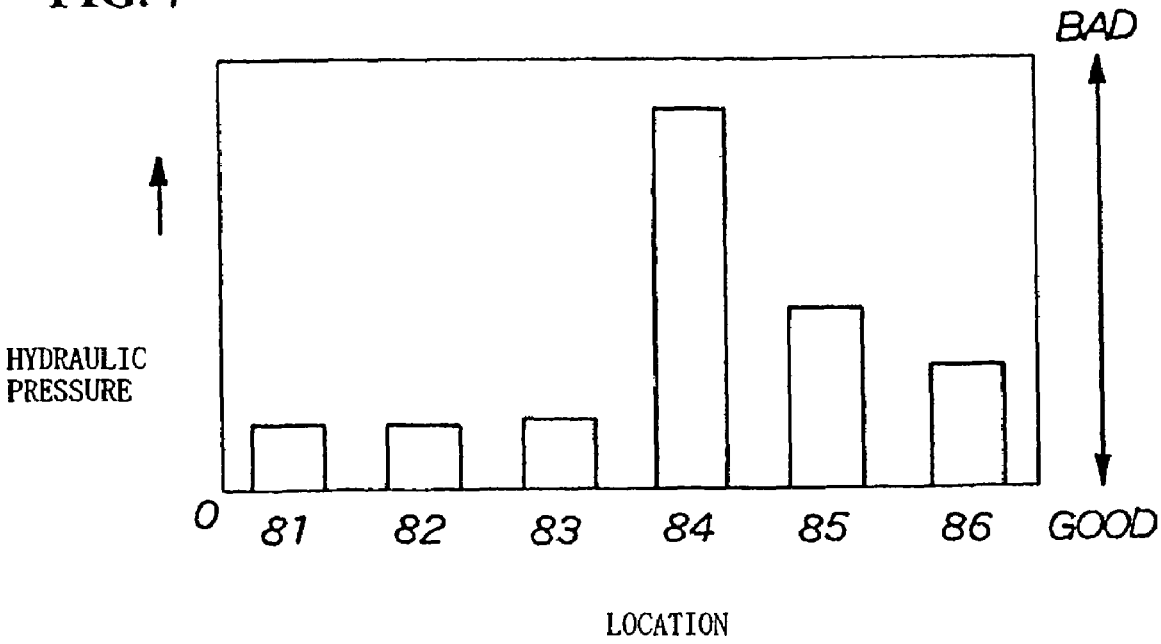
FIG. 7 is a graph of hydraulic pressure versus hole location for explaining hydraulic pressure applied to each opening shown in FIG. 6.
Figure 8:
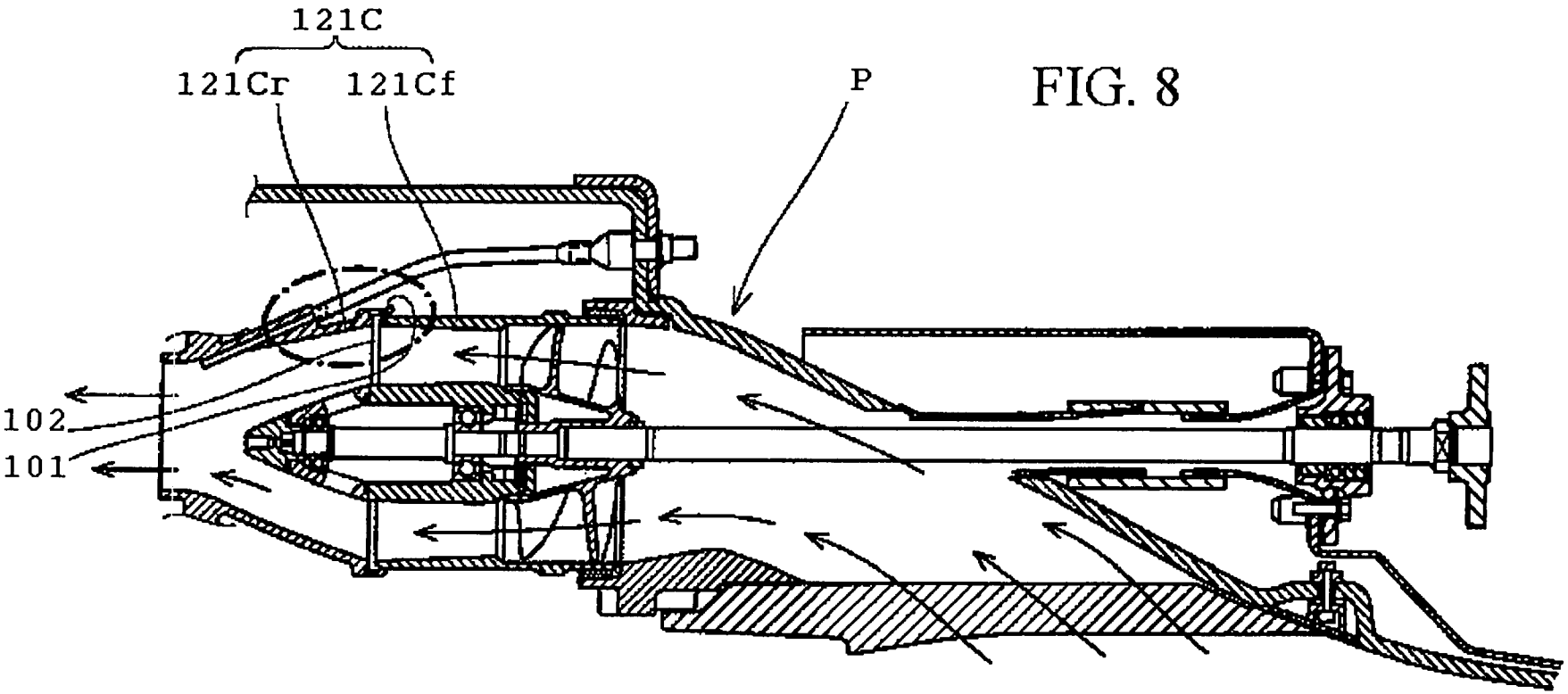
FIG. 8 is side sectional view of a prior art water propulsion unit for a small-sized boat.
Figure 9:
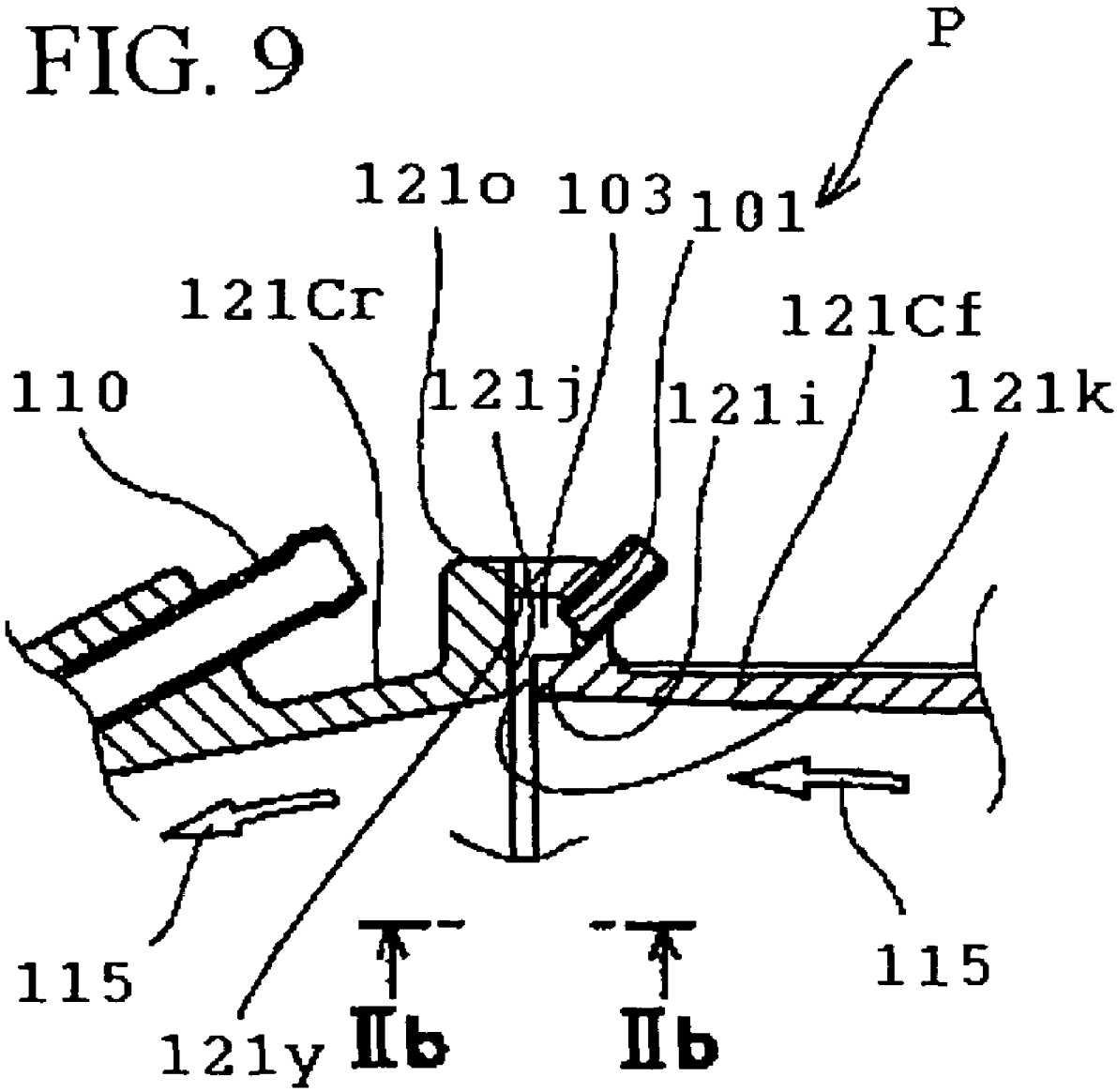
FIG. 9 is a side sectional detail view of the cooling water intake structure of the propulsion unit of FIG. 8.

FIG. 7 is a graph of hydraulic pressure versus hole location, and is used to illustrate the hydraulic pressure applied to each opening shown in FIG. 6. FIG. 7 shows that when the impeller 22 is stopped, and the boat 10 (see FIG. 1) is towed at predetermined speed, the hydraulic pressure of each opening 81, 82, 83 provided within the part 63 on the side of the first stationary blade 61 located on the left side of the bisector 59 is greatly lower than the hydraulic pressure of each opening 84, 85, 86 provided to the other part 64.

Hydraulic pressure which occurs on the left side of the bisector 59 between the stationary blades 61, 62, represented by part 63, is greatly different than the hydraulic pressure which occurs on the right side, represented by part 64. As a result, when the intake structure is provided on the part in which hydraulic pressure is lower, minimal water enters via the intake structure when the boat is towed.

Referring to FIGS. 5 again, the action according to the invention will be described below.

The invention is characterized in that since the hydraulic pressure on the side of the first stationary blade 61 relative to the bisector 59 is lowered due to the guiding action of the impeller 22, and the hydraulic pressure on the side of the second stationary blade 62 relative to the bisector 59 is raised, respectively, when the boat is towed while the impeller 22 is stopped, the intake structure 51 is provided on the part on the side of the first stationary blade 61 relative to the bisector 59.

Since more water is taken in from the intake structure 51 when the impeller 22 is turned, cooling water for cooling the engine 15 (see FIG. 1) and the exhaust system can be sufficiently taken in. The predetermined cooling performance can be secured by sufficiently taking the cooling water in.

Cooling water taken into the exhaust system when the engine 15 is operated is exhausted outside the boat by exhaust pressure or is vaporized by heat and the water muffler 47 is never filled by the cooling water.

When the impeller 22 is not turned, the hydraulic pressure on the side of the first stationary blade 61 based upon the bisector 59 is lowered by the guide action of the impeller 22, the hydraulic pressure in the part on the side of the second stationary blade 46 relative to the bisector 59 is raised, and therefore, since the intake structure 51 is provided on the part on the side of the first stationary blade 61 relative to the bisector 59, minimal water enters the intake structure 51. Since minimal water enters the intake structure 51, minimal water enters the exhaust system such as the water muffler 47 (see FIG. 1), even if the engine 15 is stopped and the boat is towed by another boat.

Since minimal water enters the exhaust system such as the water muffler 47 (see FIG. 1), difficulties in starting the engine 15 because of the infiltration of water into the exhaust system when the engine 15 are avoided.

As for the plural small holes open to the pump housing and configuring the intake structure as disclosed in the first aspect of the invention, a configuration may be used in which only one small hole is provided. In addition, the cooling water passage, attached to the outside of the pump housing, may be also integrated with the pump housing.

The invention is favorable for a boat provided with a propulsion unit.

While a working example of the present invention has been described above, the present invention is not limited to the working example described above, but various design alterations may be carried out without departing from the present invention as set forth in the claims.

What is claimed is:

1. A propulsion unit for a boat, the propulsion unit comprising a cylindrical pump housing, a rotatable impeller disposed in the cylindrical pump housing, said impeller having an upstream side and a downstream side, a plurality of stationary blades disposed within the pump housing on the downstream side of the impeller, wherein the stationary blades are provided for guiding a fluid stream in an axial direction of the pump housing, an intake structure for extracting cooling water from the pump housing and sending the cooling water to an engine, a water muffler and other water-cooled members, the intake structure disposed between a first stationary blade and a second stationary blade which is adjacent to the first stationary blade, wherein:

a bisecting line bisects the space between the first stationary blade and the second stationary blade, the intake structure is provided on a part of the pump housing on a side of the first stationary blade relative to the bisecting line, and wherein the propulsion unit is constructed and arranged such that when the boat is towed while the impeller is stopped, hydraulic pressure on the side of the first stationary blade relative to the bisecting line is lowered by the guide action of the impeller, and hydraulic pressure on a side of the second stationary blade relative to the bisecting line is raised, respectively.

2. The propulsion unit for a boat according to claim 1, wherein the propulsion unit further comprises a cooling water passage that directs cooling water to the engine, the water muffler, and other water-cooled members from the intake structure, wherein the cooling water passage is formed separately from the pump housing and is disposed outside the pump housing; and the intake structure comprises a member having a plurality of small holes formed therein.

3. The propulsion unit for a boat according to claim 1, wherein each blade of the plurality of stationary blades extend radially inward from an interior wall of the cylindrical pump housing, and each blade of the plurality of stationary blades is aligned with an axial direction of the cylindrical pump housing.

4. The propulsion unit for a boat according to claim 1, wherein when the impeller is rotating, hydraulic pressure at the intake structure is high.

5. A propulsion unit for a boat, the propulsion unit comprising a cylindrical pump housing, a rotatable impeller disposed in the cylindrical pump housing, and a plurality of stationary blades disposed on the downstream side of the impeller for guiding a fluid stream in an axial direction of the pump housing, an intake structure for extracting cooling water from the cylindrical pump housing, the cooling water sent from the intake structure to an engine, a water muffler and other water-cooled members, the intake structure disposed between a first stationary blade and a second stationary blade, the first stationary blade disposed adjacent to the second stationary blade, wherein a bisecting line bisects the space between the first stationary blade and the second stationary blade, the intake structure is provided between the first stationary blade and the second stationary blade such that the intake structure is displaced toward a side of the first stationary blade relative to the bisecting line, and when the boat is towed while the impeller is stopped, hydraulic pressure on the side of the first stationary blade relative to the bisecting line is lowered by the guide action of the impeller, and hydraulic pressure on a side of the second stationary blade relative to the bisecting line is raised, respectively.

6. The propulsion unit for a boat according to claim 5, wherein:

the first stationary blade is located on a downstream side of the second stationary blade, the downstream side corresponding to a side in a direction in which the impeller is turned.

7. The propulsion unit for a boat according to claim 5, wherein the inlet comprises a plurality of through holes formed within the cylindrical pump housing.

8. The propulsion unit for a boat according to claim 5, wherein the propulsion unit further comprises a cooling water passage that directs cooling water from the inlet to the engine, the water muffler, and other water-cooled members from the intake structure, wherein the cooling water passage is formed separately from the pump housing and is disposed outside the pump housing, one end of the cooling water passage is in fluid communication with the inlet.

9. The propulsion unit for a boat according to claim 5, wherein when the impeller is rotating, hydraulic pressure at the intake structure is high.

10. A propulsion unit for a boat, the propulsion unit comprising a cylindrical pump housing, a rotatable impeller disposed in the cylindrical pump housing, and a plurality of stationary blades disposed on the downstream side of the impeller for guiding a fluid stream in an axial direction of the pump housing, an intake structure for extracting cooling water from the cylindrical pump housing, the cooling water sent from the intake structure to an engine, a water muffler and other water-cooled members, the intake structure disposed on a portion of the cylindrical pump housing between a first stationary blade and a second stationary blade, the first stationary blade disposed adjacent to the second stationary blade, wherein the inlet is positioned relative to the first stationary blade and the second stationary blade such that when the boat is moved while the impeller is not rotating, hydraulic pressure at the inlet is low, and such that when the boat is moved while the impeller is rotating, hydraulic pressure at the inlet is high.

* * * * *